US008439524B2

(12) United States Patent
Hochstein

(10) Patent No.: US 8,439,524 B2
(45) Date of Patent: May 14, 2013

(54) LIGHT EMITTING ASSEMBLY WITH INDEPENDENT HEAT SINK LED SUPPORT

(75) Inventor: Peter A. Hochstein, Troy, MI (US)

(73) Assignee: Relume Technologies, Inc, Oxford, MI (US)

( * ) Notice: Subject to any disclaimer, the term of this patent is extended or adjusted under 35 U.S.C. 154(b) by 175 days.

(21) Appl. No.: 12/996,547

(22) PCT Filed: Jun. 5, 2008

(86) PCT No.: PCT/US2008/065874

§ 371 (c)(1),
(2), (4) Date: Jan. 21, 2011

(87) PCT Pub. No.: WO2009/148449

PCT Pub. Date: Dec. 10, 2009

(65) Prior Publication Data

US 2011/0110087 A1 May 12, 2011

(51) Int. Cl.
*F21V 29/00* (2006.01)

(52) U.S. Cl.
USPC ..... 362/294; 362/373; 362/218; 362/249.02; 362/97.3; 362/545

(58) Field of Classification Search ..... 362/612, 362/555, 545, 548, 97.3, 218, 225, 249.02, 362/249.06, 294, 373
See application file for complete search history.

(56) References Cited

U.S. PATENT DOCUMENTS

| | | | | |
|---|---|---|---|---|
| 5,808,417 | A | 9/1998 | Ference | |
| 6,045,240 | A | 4/2000 | Hochstein | |
| 6,115,252 | A | 9/2000 | Ohta et al. | |
| 6,318,886 | B1 | 11/2001 | Stopa et al. | |
| 6,999,318 | B2 * | 2/2006 | Newby | 361/719 |
| 7,374,306 | B2 * | 5/2008 | Liu | 362/27 |
| 7,628,522 | B2 * | 12/2009 | Yu et al. | 362/547 |
| 7,648,257 | B2 * | 1/2010 | Villard | 362/294 |
| 7,922,354 | B2 * | 4/2011 | Everhart | 362/235 |
| 8,035,284 | B2 * | 10/2011 | Hasnain | 313/45 |
| 8,075,150 | B2 * | 12/2011 | Maruyama | 362/97.1 |
| 2003/0156416 | A1 * | 8/2003 | Stopa et al. | 362/294 |
| 2004/0213016 | A1 | 10/2004 | Rice | |
| 2005/0022972 | A1 | 2/2005 | Cheng et al. | |
| 2005/0047170 | A1 * | 3/2005 | Hilburger et al. | 362/547 |
| 2005/0213328 | A1 * | 9/2005 | Matheson | 362/267 |
| 2006/0227554 | A1 * | 10/2006 | Yu | 362/294 |
| 2006/0291202 | A1 * | 12/2006 | Kim | 362/228 |
| 2007/0080362 | A1 | 4/2007 | Scotch et al. | |
| 2007/0115641 | A1 | 5/2007 | Huang | |
| 2008/0043473 | A1 | 2/2008 | Matsui | |
| 2010/0053966 | A1 * | 3/2010 | Tu et al. | 362/249.02 |

* cited by examiner

*Primary Examiner* — Ismael Negron
(74) *Attorney, Agent, or Firm* — Dickinson Wright, PLLC

(57) ABSTRACT

A light emitting assembly (10) is fabricated by forming a continuous strip of aluminum heat sink having a pair of fins (32) aligned with the side edges (20) and cutting the continuous strip into a plurality of elongated sections (18). The elongated sections (18) are disposed in spaced and generally parallel relationship to one another and separated by an elongated slot (26) so that adjacent elongated sections (18) are independent of one another. A plurality of light emitting diodes (24) are disposed on the mounting surface (14) of each elongated section (18). Bridges (28) constructed of a material different from the material of the heat sink interconnect the elongated sections (18). An independent cover (52) is adhesively secured to the mounting surface (14) around the light emitting diodes (24) on each elongated section (18). A housing (56) spaced from the fins (32) is disposed over the assembly (10).

23 Claims, 4 Drawing Sheets

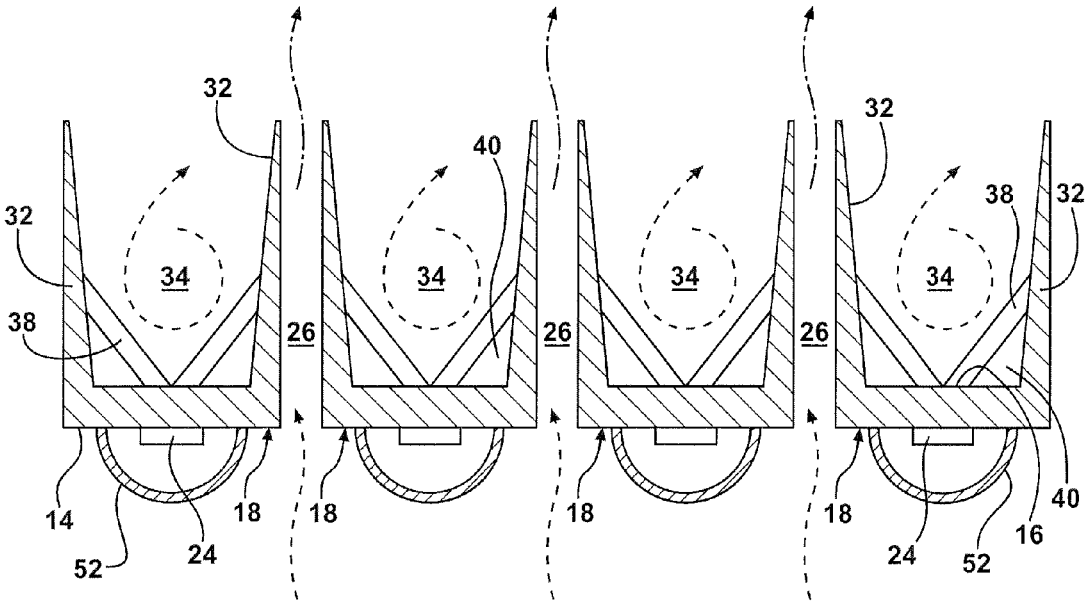
FIG - 3
FIG - 4
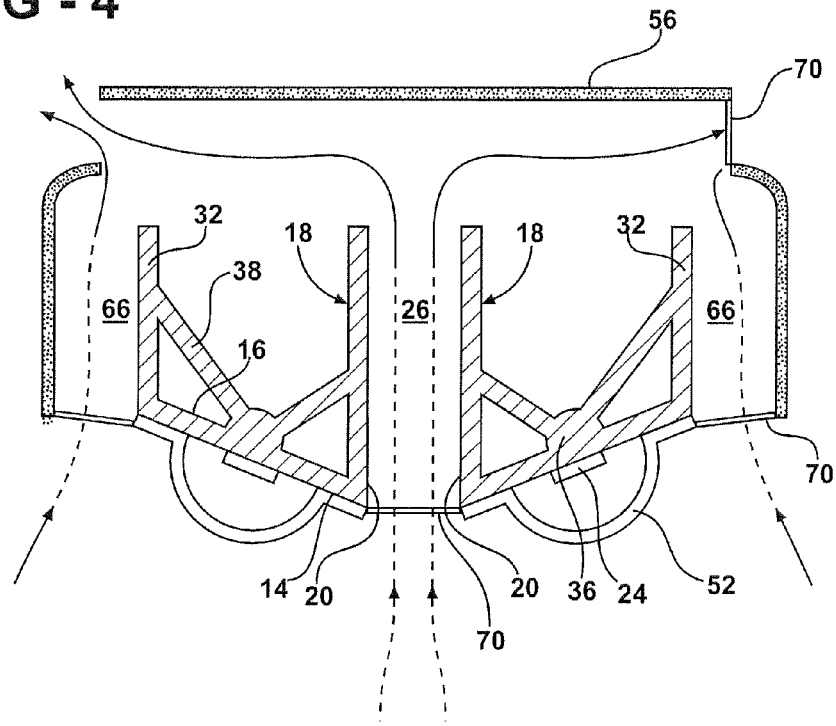

LIGHT EMITTING ASSEMBLY WITH INDEPENDENT HEAT SINK LED SUPPORT

CROSS-REFERENCE TO RELATED APPLICATIONS

This application is a National Stage of International Application No. PCT/US 2008/065874, filed Jun. 5,2008.

BACKGROUND OF THE INVENTION

1. Field of the Invention

The subject invention relates to a light emitting assembly of the type including light emitting diodes (L.E.D.s) and the method of manufacturing such a light emitting assembly.

2. Description of the Prior Art

An example of such an assembly is disclosed in the U.S. Pat. No. 5,857,767 to the present inventor, Peter A. Hochstein. The Hochstein 767 patent discloses a plurality of L.E.D.s disposed on the mounting surface of a heat sink formed by casting. A separate and independent heat sink casting and manufacturing process is required accordingly for each distinct mounting surface configuration and dedicated use.

SUMMARY OF THE INVENTION

The subject invention provides such a light emitting assembly including a plurality of light emitting diodes disposed on the mounting surface of a heat sink defined by a plurality of elongated sections extending between opposite ends. The elongated sections are disposed in generally parallel relationship to one another to present side edges extending continuously between the ends of the elongated sections to separate and render adjacent elongated sections and the L.E.D.s on the mounting surface thereof independent of one another.

The subject invention also provides for a method of manufacturing such a light emitting assembly including the steps of forming a continuous strip of heat sink presenting a mounting surface, dividing the strip into a plurality of elongated sections extending between ends, disposing a plurality of L.E.D.s on the mounting surface of each elongated section, and disposing the elongated sections in generally parallel relationship to one another to present side edges extending continuously between ends of the elongated sections to renders adjacent elongated sections and the L.E.D.s on the mounting surface thereof independent of one another.

ADVANTAGES OF THE INVENTION

A typical application of the thermally efficient L.E.D. assembly of the present invention is in street lamps, traffic signals of all types, message boards, and other large area light emitting assemblies. The subject invention improves manufacturing efficiency and reduces costs because a single forming process, for example extrusion, may generate a heat sink defined by independent elongated sections capable of being arranged in various configurations and having various dedicated uses. The independent elongated sections may be configured so that the L.E.D.s on the mounting surface of adjacent elongated sections are canted with respect to one another in order to achieve a desired optical beam pattern and photometric performance based on the intended use of the assembly. The independent elongated sections may be arranged in various geometries, for example adjacent to one another in a horizontal plane, or spaced from one another to form a 'C' shape. In addition, the fins and ribs of the elongated sections may be formed during a single forming process, which also improves manufacturing efficiency and reduces costs.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a cross sectional view of a second embodiment taken along line 2-2 of FIG. 1 wherein the elongated sections include side ribs;

FIG. 4 is a cross sectional view of a third embodiment taken along line 2-2 of FIG. 1 wherein the heat transfer surface has an angle other than ninety degrees relative to the parallel fins.

DETAILED DESCRIPTION OF THE INVENTION

Figure 1:
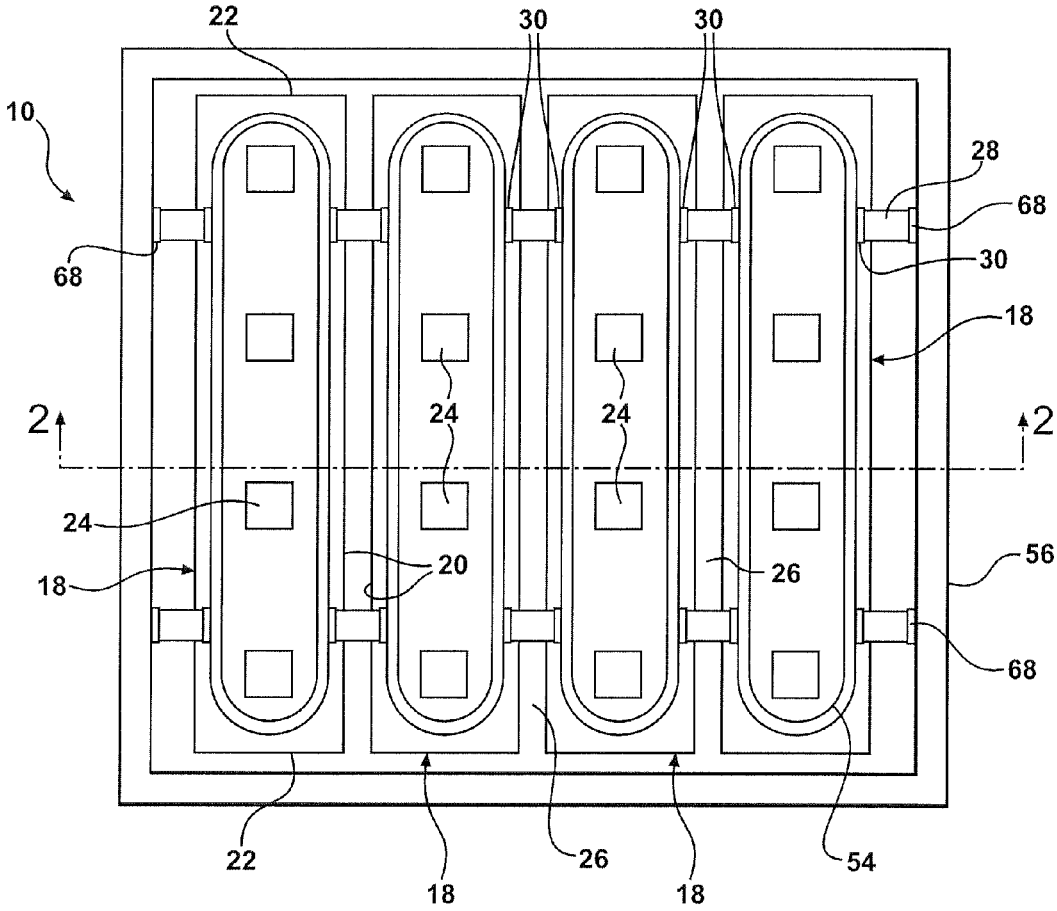
FIG. 1 is plan (frontal) view of a preferred embodiment of the subject invention.

Referring to the Figures, a light emitting assembly 10 is generally shown. The light emitting assembly 10 comprises a thermally conductive heat sink defined by a plurality of elongated sections 18. The heat sink is preferentially made of metal, such as a homogeneous aluminum or an aluminum alloy. The heat sink is formed to present a mounting surface 14 and an oppositely facing heat transfer surface 16 and then divided into the plurality of elongated sections 18. The elongated sections 18 are disposed in generally parallel relationship to one another to present side edges 20 extending between the ends 22 of the elongated sections 18. The elongated sections 18, as shown in FIG. 1, each have the same length, width, and thickness. However, each of the elongated sections 18 may have lengths, widths, and thicknesses that differ from those shown and from one another. In addition, the elongated sections 18 may be canted at angles to direct light from the L.E.D.s 24 thereof in various different directions to achieve a desired optical beam pattern and photometric performance based on the intended use of the assembly 10. The elongated sections 18 are preferably formed by extrusion, but may be formed by forging, casting, or the like.

Figure 5:
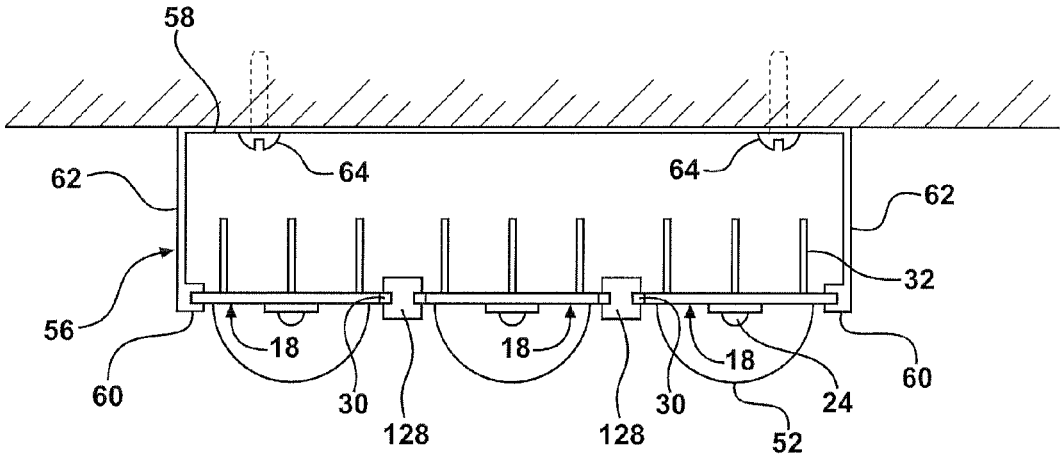
FIG. 5 is a cross-sectional view of a fourth embodiment of the invention including a vertically mounted housing.
Figure 6:
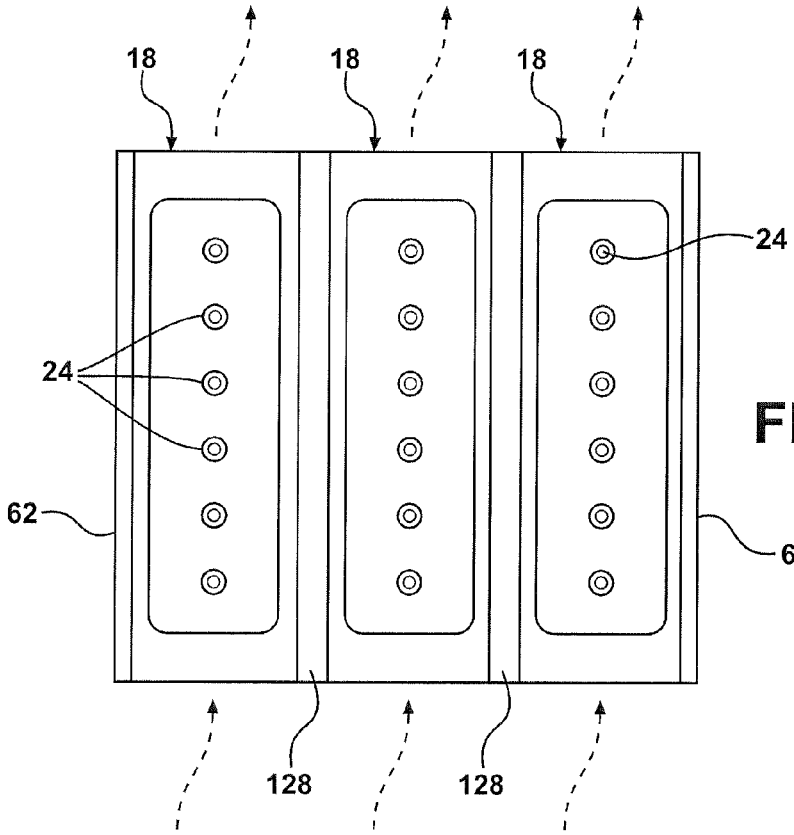
FIG. 6 is a plan (frontal) view of the embodiment of FIG.5.

The elongated sections 18 may be placed directly in engagement with one another, as shown in FIGS. 5 and 6. However, in the preferred embodiment of the present invention, the elongated sections 18 are spaced from one another so that the side edges 20 of adjacent elongated sections 18 define an elongated slot 26 extending continuously along the side edges 20 between the ends 22 of each of the elongated sections 18. Each of the elongated slots 26 separates and renders adjacent elongated sections 18 and the L.E.D.s 24 on the mounting surface 14 thereof independent of one another, as shown in FIG. 1. The elongated slots 26 enhance the convective cooling of the assembly 10 by allowing ambient air to pass by each of the independent elongated sections 18 . The elongated slots 26 are shown as each having the same length and width.

Figure 2:
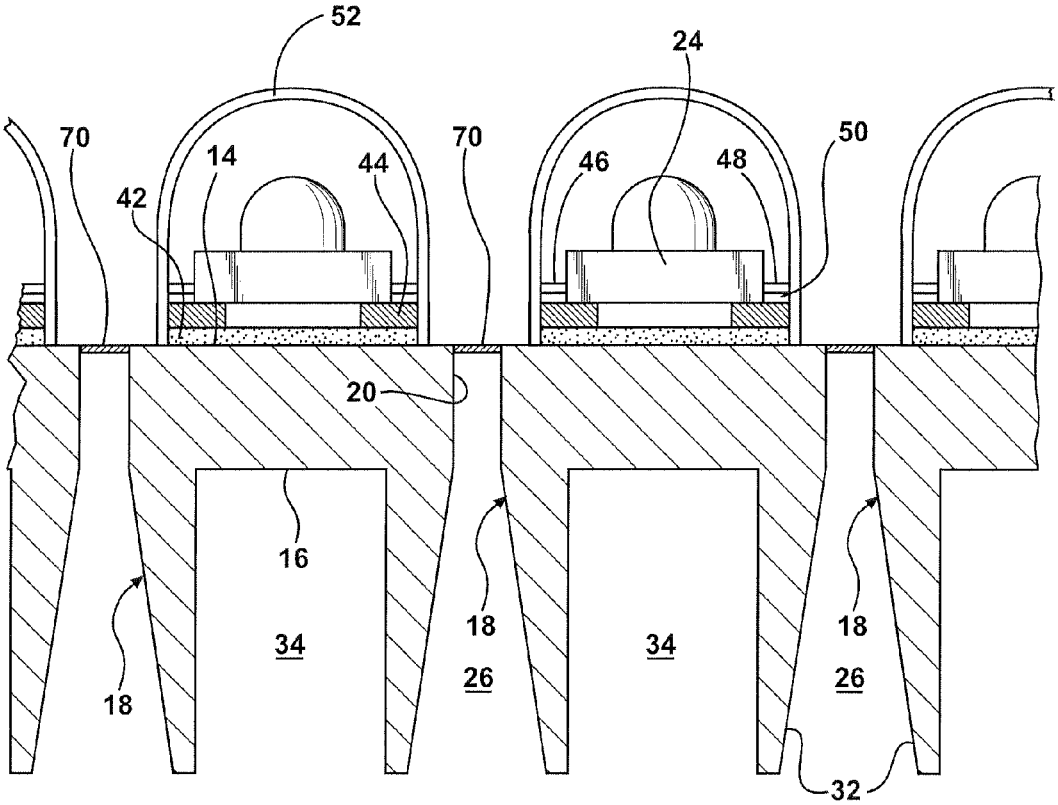
FIG. 2 is a fragmentary cross sectional view taken along line 2-2 of FIG. 1.

The assembly 10 includes at least one bridge 28, 128 but preferably a pair of bridges 28, 128 spaced and parallel to one another and extending transversely to each of the elongated slots 26, as shown in FIG. 2. In the preferred embodiment, the bridges 28, 128 separate adjacent elongated sections 18 by the elongated slots 26 and interconnect adjacent elongated sections 18. Alternatively, the bridges 128 may comprise a strip disposed between adjacent elongated sections 18 and extending continuously between opposite ends 22 of the elongated sections 18, as shown in FIG. 5. In the preferred embodiment, the bridges 28, 128 are independent of the elongated sections 18 and comprise a material different from the material of the heat sink. In FIG. 1, the bridges 28 are shown as extending transverse to the elongated slots 26, but they may extend at other angles relative to the elongated slots 26. The bridges 28, 128 are securely connected to each of the elongated sections 18 by a plurality of bridge connectors 30 so that the elongated sections 18 may be held in a fixed position. The bridge connectors 30 may be one of many possible adhesives or mechanical connectors, such as a nut and bolt or a screw.

Each of the elongated sections 18 include a plurality of fins 32 extending transversely from the heat transfer surface 16 and disposed in spaced and parallel relationship to one another. The fins 32 extend continuously between the ends 22 of each of the elongated sections 18 to present a first void space 34 between adjacent fins 32. The fins 32 are open at the ends 22 for exposing the first void space 34 between adjacent fins 32 to air. The fins 32 are designed to enhance the transfer of heat away from the heat sink to surrounding ambient air. In the preferred embodiment, one of the fins 32 is aligned with each of the edges 20 so that each of the edges 20 and associated aligned fins 32 present a continuous surface adjacent to each of the elongated slots 26, as shown in FIG. 2. Alternatively, the fins 32 may be discontinuous or perforated to enhance convective cooling. They may extend at other angles relative to the heat transfer surface 16 and may be placed in other positions relative the elongated slots 26. The fins 32 may also have different cross sectional shapes than those shown The heat transfer surface 16 may also include a longitudinal rib 36 extending continuously into the first void space 34 and longitudinally between the ends 22 of each of the elongated sections 18, as shown in FIG. 3. Each elongated section 18 may also include a pair of side ribs 38 each extending longitudinally between the ends 22 of each of the elongated sections 18. The side ribs 38 extend radially from the heat transfer surface 16 to the fins 32 to present a second void space 40 between the heat transfer surface 16 and each of the side ribs 38 and the fins 32. The additional ribs 36, 38 are designed to enhance the heat transfer of heat away from the heat sink to surrounding air. Although the ribs 36, 38 are shown as described above, they may comprise different shapes and extend at other angles relative to the heat transfer surface 16.

An alternative embodiment of the invention includes the heat transfer surface 16 being disposed at an angle other than ninety degrees relative to the parallel fins 32 thereof, as shown in FIG. 4. The independent elongated sections 18 allow the heat transfer surface 16 of adjacent elongated sections 18 to be disposed at angles different from one another so that light from the L.E.D.s 24 may be directed in more than one direction to achieve a desired optical beam pattern and photometric performance. Elongated sections 18 comprising a single heat transfer surface 16 configuration are capable of directing light in different directions by disposing the heat transfer surfaces 16 of adjacent elongated sections 18 at angles opposite one another, as shown in FIG. 4.

The assembly 10 includes an electrically insulating coating 42 disposed over the mounting surface 14. The coating 42 is less than one thousand microns thick, but preferably less than three hundred microns thick. The coating 42 may be continuous and cover the entire mounting surface 14, or it may be disposed in circuitous tracks separated from one another by the bare metal of the respective elongated section 18.

Circuit traces 44 are disposed in spaced lengths from one another on the mounting surface 14 to prevent electrical conduction between the traces 44. The traces 44 extend in end to end relationship along at least one of the elongated sections 18. The coating 42 prevents electrical conduction from each of the traces 44 to the heat sink. The traces 44 may consist of a polymetric material having metal particles dispersed therein, such as an expoxy compound with a noble metal, or a phenolic resin compounded with either copper, silver, or nickel.

A plurality of L.E.D.s 24 are disposed on the mounting surface 14 to span the spaces between the ends of adjacent traces 44. Each one has a positive lead 46 and a negative lead 48 being in electrical engagement with the adjacent ones of the traces 44 to electrically interconnect the traces 44 and the L.E.D.s 24. The L.E.D.s 24 are disposed in the spaces between adjacent traces 44 on each one of the elongated sections 18. An electrically conductive adhesive 50 secures the leads 46, 48 of the light emitting diodes 24 to adjacent ones of the circuit traces 44. The L.E.D.s 24 on each of the elongated sections 18 may be electrically interconnected in series with one another and electrically interconnected in parallel with the ones on other elongated sections 18. The L.E.D.s 24 on each of the elongated sections 18 are shown as being disposed parallel to one another and having a uniform space between each adjacent light emitting diode 24. However, the plurality of L.E.D.s 24 on each elongated section 18 may be disposed in a non-parallel alignment relative to the L.E.D.s 24 on adjacent elongated sections 18, and the individual L.E.D.s 24 may have non-uniform spaces between one another. The electrical components of the assembly 10 are connected with printed, foil or wire conductors, and the conductor feed-throughs must be sealed when the assembly 10 is used outdoors.

The assembly 10 includes plurality of independent covers 52, with each cover 52 being disposed over one of the elongated sections 18 so that one cover 52 independently covers 52 the L.E.D.s 24 on each of the elongated sections 18. The independent covers 52 are light transmissive and formed of a glass or plastic material, such as polycarbonate. The independent covers 52 protect the L.E.D.s 24 and electrical components from precipitation, debris, sunlight, and other harmful effects that would be detrimental to the operation of the assembly 10. Each cover 52 defines a periphery 54 being in sealed engagement with the mounting surface 14 around the traces 44 of the L.E.D.s 24 without obstructing the ability of air to flow through the plurality of elongated slots 26 between the elongated sections 18. Although the covers 52 are shown as having similar lengths, widths, and cross sectional shapes, they may have lengths, widths, and cross sectional shapes that differ from those shown and from one another. The cover 52 is attached to the respective elongated section 18, such as by an adhesive material, like RTV silicone rubber. Other attachments may be used such as double faced foam tape or a replaceable gasket.

The assembly 10 also includes a housing 56, shown in FIG. 4, covering and spaced from the heat transfer surface 16 of the heat sink to allow convective air flow over the fins 32. In one embodiment of the present invention, the housing 56 is designed for vertical mounting and includes a back wall 58 extending between open housing ends 60 and side walls 62 extending transversely from the back wall 58 to the elongated sections 18 to define a U-shape in cross section 18 extending between the open housing ends 60, as shown in FIG. 5. When the housing 56 is vertically mounted, as shown if FIGS. 5 and 6, mounting anchors 64 may extend through the back wall 58 of the housing 56 to connect the housing 56 to a vertical surface. The back wall 58 is spaced from the heat transfer surface 16 and fins 32 to permit advantageous convective air flow vertically over fins 32 and through the vertically mounted housing 56.

The housing 56 is designed to shield the elongated sections 18 from precipitation, debris, and other harmful effects that would be detrimental to the assembly's 10 operation. The housing 56 also shields the elongated sections 18 from sunlight, which reduces the temperature of the assembly 10. It may consist of a thermophastic, vacuum formed polyester [TPO] material, a molded polycarbonate, or a metal material such as stainless steel, for corrosion protection. The housing 56, as shown in FIG. 4, includes two hot air vents 66 for allowing ambient air to pass through the housing 56. However, it may include even more hot air vents 66 or none at all. The housing 56 is secured to the assembly 10 with at least one housing connector 68, such a spring clip. Other types of mechanical connectors or adhesives may be used.

A screen 70 is be disposed over each of the elongated slots 26 to prevent insects, leaves, and other debris from clogging the elongated slots 26 and impeding the convective air flow through the elongated slots 26. A screen 70 may also be disposed over the vents 66 in the housing 56.

The subject invention also includes a method of manufacturing the light emitting assembly 10 including a heat sink defined by a plurality of elongated sections 18 preferentially of thermally conductive aluminum material and each presenting a mounting surface 14 and an oppositely facing heat transfer surface 16 and a plurality of fins 32 extending transversely from the heat transfer surface 16 and disposed in spaced and parallel relationship to one another. As alluded to above, the method comprises the step of forming a continuous strip of heat sink of thermally conductive material having a cross section presenting the mounting surface 14 and the oppositely facing heat transfer surface 16. The heat sink is also formed to have a plurality of fins 32 extending transversely from the heat transfer surface 16 and disposed in spaced and parallel relationship to one another to present a first void space 34 between each pair of fins 32. The elongated sections 18 are usually formed by an extrusion process. Other forming means may include casting, roll forming, stamping, bending or drawing processes.

The fins 32 may be formed integrally with and of the same material and by the same process or simultaneously with the extruded elongated sections 18. Alternatively, they may be formed of a different material and non-simultaneously with the elongated sections 18.

The method of manufacturing may involve extruding or forming the heat transfer surface 16 on each of the elongated sections 18 at an angle other than ninety degrees relative to the parallel fins 32 thereof. The forming may also involve extruding a pair of side ribs 38 extending radially from the heat transfer surface 16 to the fins 32 to present a second void space 40 between the heat transfer surface 16 and each of the side ribs 38 and the fins 32 and extending longitudinally between the ends 22 of each of the elongated sections 18. Alternatively, the method may comprise forming the side ribs 38 independently of the extruding and then connecting the post-formed ribs 36, 38 to the elongated sections 18. The fins 32 may also be formed integrally with and of the same material and by the same process or simultaneously with the elongated sections 18 during an extrusion process. However, the fins 32 may comprise certain shapes that are difficult to extrude, in which case they are formed of a different material and by a different process than the elongated sections 18.

Next, the strip of heat sink of thermally conductive material is divided into the plurality of elongated sections 18 extending between the ends 22. The method includes dividing the heat sink into the elongated sections 18 completely independent of one another so that the void space between each pair of fins 32 is open at the ends 22. The elongated sections 18 are disposed in spaced and parallel relationship to one another and to present side edges 20 defining an elongated slot 26 extending continuously between the ends 22 and along adjacent edges 20 of the elongated sections 18. If the heat transfer surfaces 16 of the elongated sections 18 are formed at an angle relative to the fins 32, then the disposing of the elongated sections 18 may be further defined by aligning the heat transfer surfaces 16 of adjacent elongated sections 18 at opposite angles relative to one another.

The method includes constructing bridges 28, 128 usually independent of or by a different process than the elongated sections 18. The method next includes interconnecting adjacent elongated sections 18 with the bridges 28, 128. In one embodiment, shown in FIG. 1, the bridges 28 are disposed spaced and parallel to one another and extend transversely across each of the elongated slots 26 to separate the adjacent elongated sections 18 by the elongated slots 26. Alternatively, the bridges 28 may extend at angles, other than perpendicularly, relative to the elongated slots 26 and sections 18. The bridges 28, 128 are connected to the elongated sections 18 with a plurality of bridge connectors 30, e.g., adhesives 50 or mechanical fasteners.

The method further comprises applying a coating 42 of electrically insulating material over the mounting surface 14 of the heat sink and then disposing a plurality of circuit traces 44 spaced from one another on the coating 42. A screen printing method may be used to apply the coating 42 and the circuit traces 44 to the heat sink.

The method further comprises disposing a plurality of light emitting diodes 24 on the elongated sections 18 in the spaces between adjacent ones of the traces 44. The leads 46, 48 of the light emitting diodes 24 are secured to the traces 44 with an electrically conductive adhesive 50. The disposing of the light emitting diodes 24 is further defined as electrically engaging the light emitting diodes 24 with adjacent ones of the traces 44 to electrically interconnect the traces 44 and the light emitting diodes 24. The method also includes electrically interconnecting the light emitting diodes 24 on each of the elongated sections 18 in series with one another and in parallel with the light emitting diodes 24 on all other of the elongated sections 18. The L.E.D.s 24 are applied with an adhesive 50 as by a mechanical applicator, a stencil, or a robot pick and place machine.

The method further comprises disposing a plurality of independent covers 52 over the elongated sections 18. One independent cover 52 is securely attached to each elongated section 18 with at least one attachment, such as an adhesive material, like RTV silicone rubber. Finally, a housing 56 is disposed over the assembly 10. The housing 56 is spaced from the heat transfer surface 16 of the heat sink 12 and fins 32. The housing 56 is formed as by a vacuum, injection molding, or drawn from thin metal.

Obviously, many modifications and variations of the present invention are possible in light of the above teachings and may be practiced otherwise than as specifically described while within the scope of the appended claims. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A light emitting assembly (10) comprising:

a heat sink presenting a mounting surface (14), a plurality of light emitting diodes (24) disposed on said mounting surface (14), said heat sink being defined by a plurality of elongated sections (18) extending between opposite ends (22) and being disposed in generally parallel relationship to one another to present side edges (20) extending continuously between said ends (22) to separate and render adjacent elongated sections (18) and said light emitting diodes (24) on said mounting surface (14) thereof independent of one another, at least one bridge (28, 128) interconnecting adjacent elongated sections (18) to maintain said elongated sections (18) connected together, and wherein said at least one bridge (28, 128) comprises a material different from the material of said heat sink.

2. An assembly (10) as set forth in claim 1 wherein said at least one bridge (28) comprises a pair of said bridges (28) spaced and parallel to one another and extending transversely to said elongated sections (18) to interconnect adjacent elongated sections (18).

3. An assembly (10) as set forth in claim 1 wherein said at least one bridge (128) comprises a strip disposed between adjacent elongated sections (18) and extending continuously between opposite ends (22) of said elongated sections (18).

4. An assembly (10) as set forth in claim 1 including a plurality of independent covers (52) with each cover (52) being light transmissive and disposed over one of said elongated sections (18) so that one cover (52) independently covers said light emitting diodes (24) on each of said elongated sections (18).

5. An assembly (10) as set forth in claim 1 wherein said heat sink presents a heat transfer surface (16) facing in the opposite direction from said mounting surface (14) and including a plurality of fins (32) extending transversely from said heat transfer surface (16) of said heat sink for transferring heat away from said heat sink to surrounding air.

6. An assembly (10) as set forth in claim 5 including a housing (56) covering and spaced from said heat transfer surface (16) and said fins (32) for shielding said elongated sections (18).

7. An assembly (10) as set forth in claim 5 wherein said heat transfer surface (16) on each of said sections (18) is disposed at an angle other than ninety degrees relative to said fins (32) thereof.

8. An assembly (10) as set forth in claim 7 including at least one bridge (28, 128) interconnecting adjacent elongated sections (18) to maintain said elongated sections (18) connected together.

9. An assembly (10) as set forth in claim 1 wherein said side edges (20) of adjacent elongated sections (18) define an elongated slot (26) therebetween extending continuously along said side edges (20) between said ends (22) of said adjacent elongated sections (18) so that each of said elongated slots (26) separates and renders adjacent elongated sections (18) spaced from one another.

10. An assembly (10) as set forth in claim 9 including at least one bridge (28, 128) interconnecting adjacent elongated sections (18) to maintain said elongated sections (18) connected together and separating adjacent elongated sections (18) by said elongated slots (26).

11. An assembly (10) as set forth in claim 10 wherein said at least one bridge (28) comprises a pair of said bridges (28) spaced and parallel to one another and extending transversely to said elongated sections (18) and said elongated slots (26).

12. An assembly (10) as set forth in claim 10 wherein said at least one bridge (128) comprises a strip disposed between adjacent elongated sections (18) and extending continuously between opposite ends (22) of said elongated sections (18).

13. A light emitting assembly (10) comprising:

a heat sink of thermally conductive aluminum material presenting a mounting surface (14) and a heat transfer surface (16) facing in the opposite direction from said mounting surface (14), said heat sink being defined by a plurality of elongated sections (18) extending between opposite ends (22), each of said elongated sections (18) being disposed in spaced and parallel relationship to one another to present side edges (20) defining an elongated slot (26) therebetween extending continuously between said ends (22) and along adjacent edges (20) of said elongated sections (18) to separate and render adjacent elongated sections (18) and said light emitting diodes (24) on said mounting surface (14) thereof independent of one another, said heat sink including a plurality of fins (32) extending transversely from said heat transfer surface (16) and disposed in spaced and parallel relationship to one another for transferring heat away from said heat sink to surrounding ambient air, said fins (32) extending continuously between said ends (22) of each of said elongated sections (18) to present a first void space (34) between adjacent fins (32) and open at said ends (22) for exposing said first void space (34) between said adjacent fins (32) to air, a plurality of bridges (28, 128) interconnecting adjacent elongated sections (18) to maintain said elongated sections (18) connected together, said bridges (28, 128) being independent of and comprising a material different from the material of said heat sink, a plurality of bridge connectors (30) securely connecting said bridges (28, 128) to each of said elongated sections (18), a coating (42) of electrically insulating material disposed over said mounting surface (14) of said heat sink, said coating (42) being less than one thousand microns in thickness, a plurality of circuit traces (44) spaced from one another on said coating (42) for preventing electrical conduction between said traces (44) so that said coating (42) prevents electrical conduction from each of said traces (44) to said heat sink, a plurality of light emitting diodes (24) disposed in spaces (34, 40) between adjacent ones of said traces (44), each of said light emitting diodes (24) having a positive lead (46) and a negative lead (48), said leads (46, 48) of each of said L.E.D.s (24) being in electrical engagement with said adjacent ones of said traces (44) for electrically interconnecting said traces (44) and said light emitting diodes (24), an adhesive (50) of electrically conductive material securing said leads (46, 48) to said traces (44), said light emitting diodes (24) on each of said elongated sections (18) being electrically interconnected in series with one another, said light emitting diodes (24) on each of said elongated sections (18) being electrically interconnected in parallel with said light emitting diodes (24) on other elongated sections (18), at least three of said traces (44) extending in end (22) to end (22) relationship along each of said elongated sections (18), at least two of said light emitting diodes (24) disposed in each of the two spaces (34, 40) between said three adjacent traces (44) on each one of said elongated sections (18), a plurality of independent covers (52) with each cover (52) being light transmissive and disposed over one of said elongated sections (18) so that one cover (52) independently covers (52) said light emitting diodes (24) on each of said elongated sections (18), each of said covers (52) defining a periphery (54) in sealed engagement with said mounting surface (14) around said light emitting diodes (24), a housing (56) covering and spaced from said heat transfer surface (16) and said fins (32) for shielding said elongated sections (18), said housing (56) including at least one vent (66) for allowing air to pass through said housing (56), and a plurality of housing connectors (68) securely connecting said housing (56) to at least one of said elongated sections (18).

14. A light emitting assembly (10) as set forth in claim 13 wherein said housing (56) includes a back wall (58) extending between open housing ends (60) and spaced from said fins (32) and side walls (62) extending transversely from said back wall (58) to said elongated sections (18) to define a U-shape in cross section (18) extending between said open ends (60) for allowing air to flow along said fins (32) and through said housing (56).

15. A light emitting assembly (10) comprising:

a heat sink presenting a mounting surface (14), a plurality of light emitting diodes (24) disposed on said mounting surface (14), said heat sink being defined by a plurality of elongated sections (18) extending between opposite ends (22) and being disposed in generally parallel relationship to one another to present side edges (20) extending continuously between said ends (22) to separate and render adjacent elongated sections (18) and said light emitting diodes (24) on said mounting surface (14) thereof independent of one another, wherein said heat sink presents a heat transfer surface (16) facing in the opposite direction from said mounting surface (14) and including a plurality of fins (32) extending transversely from said heat transfer surface (16) of said heat sink for transferring heat away from said heat sink to surrounding air, a housing (56) covering and spaced from said heat transfer surface (16) and said fins (32) for shielding said elongated sections (18), and wherein said housing (56) includes a back wall (58) extending between open ends (60) and spaced from said fins (32) and side walls (62) extending transversely from said back wall (58) to said elongated sections (18) to define a U-shape in cross section extending between said open ends (60) for allowing air to flow along said fins (32) and through said housing (56).

16. A method of manufacturing a light emitting assembly (10) of the type including a plurality of L.E.D.s (24) disposed on the mounting surface (14) of a heat sink defined by independent elongated sections (18), and comprising the steps of:

extruding a continuous strip of the heat sink having a cross section (18) presenting the mounting surface (14) and the heat transfer surface (16) and fins (32) extending from the heat transfer surface (16), cutting the strip of heat sink into a plurality of elongated sections (18) extending between ends (22), disposing the L.E.D.s (24) on the mounting surface (14) of each elongated section (18), disposing the elongated sections (18) in generally parallel relationship to one another to present side edges (20) extending between the ends (22) and along adjacent edges (20) of the elongated sections (18), and interconnecting the adjacent elongated sections (18) with at least one bridge (28, 128) to maintain the elongated sections (18) connected together.

17. A method of manufacturing a light emitting assembly (10) of the type including a plurality of L.E.D.s (24) disposed on the mounting surface (14) of a thermally conductive heat sink defined by independent elongated sections (18), and comprising the steps of:

forming a continuous strip of the heat sink having a cross section presenting the mounting surface (14), dividing the strip of heat sink into a plurality of elongated sections (18) extending between ends (22), disposing the L.E.D.s (24) on the mounting surface (14) of each elongated section (18), and disposing the elongated sections (18) in generally parallel relationship to one another to present side edges (20) extending between the ends (22) and along adjacent edges (20) of the sections (18).

18. A method as set forth in claim 17 further comprising interconnecting the adjacent elongated sections (18) with at least one bridge (28, 128) extending transversely between adjacent elongated sections (18).

19. A method as set forth in claim 17 further comprising spacing the elongated sections (18) apart from one another so that the side edges (20) of adjacent elongated sections (18) define an elongated slot (26) separating and rendering adjacent elongated sections (18) and the L.E.D.s (24) on the mounting surface (14) thereof independent of one another.

20. A method as set forth in claim 17 further comprising forming a plurality of fins (32) integral with the extruded heat sink and extending transversely from the heat transfer surface (16) facing in the opposite direction from the mounting surface (14) of the heat sink and disposed in spaced and parallel relationship to one another.

21. A method as set forth in claim 20 further comprising disposing a housing (56) over and spaced from the heat transfer surface (16) and the fins (32) for shielding the elongated sections (18).

22. A method as set forth in claim 20 wherein said forming a heat sink is further defined as forming a pair of side ribs (38) extending radially from the heat transfer surface (16) to the fins (32) to present a second void space (40) between the heat transfer surface (16) and each of the side ribs (38) and the fins (32) and extending longitudinally between the ends (22) of each of the sections (18) for transferring heat away from the heat sink to ambient air.

23. A method as set forth in claim 20 wherein said forming a heat sink is further defined as forming the mounting surface (14) on each of the elongated sections (18) at an angle other than ninety degrees relative to the parallel fins (32) thereof.

* * * * *